US012220048B2

(12) United States Patent
Zhou

(10) Patent No.: US 12,220,048 B2
(45) Date of Patent: Feb. 11, 2025

(54) RETRACTABLE INTERDENTAL BRUSH

(71) Applicant: Xing Zhou, Guangzhou (CN)

(72) Inventor: Xing Zhou, Guangzhou (CN)

( * ) Notice: Subject to any disclaimer, the term of this patent is extended or adjusted under 35 U.S.C. 154(b) by 796 days.

(21) Appl. No.: 17/341,215

(22) Filed: Jun. 7, 2021

(65) Prior Publication Data

US 2021/0289931 A1 Sep. 23, 2021

Related U.S. Application Data

(63) Continuation of application No. PCT/CN2019/088426, filed on May 24, 2019.

(30) Foreign Application Priority Data

Dec. 29, 2018 (CN) ..... 201811648006.4

(51) Int. Cl.
*A46B 9/04* (2006.01)
*A46B 5/00* (2006.01)
(Continued)

(52) U.S. Cl.
CPC ..... *A46B 7/023* (2013.01); *A46B 5/0037* (2013.01); *A46B 9/026* (2013.01); *A46B 9/04* (2013.01); *A46B 2200/108* (2013.01)

(58) Field of Classification Search
CPC ..... A46B 9/04; A46B 7/02; A61C 17/32
See application file for complete search history.

(56) References Cited

U.S. PATENT DOCUMENTS

2001/0012605 A1* 8/2001 Kawamura ..... A61C 17/0202 433/29
2008/0254408 A1* 10/2008 Coates ..... A61C 15/00 433/105
(Continued)

FOREIGN PATENT DOCUMENTS

CN 202425871 U 9/2012
CN 203801948 U 9/2014
(Continued)

OTHER PUBLICATIONS

Zhou, Xing, Supplementary European Search Report, EP19904520.4, Jun. 27, 2022, 7 pgs.
(Continued)

*Primary Examiner* — Michael D Jennings
(74) *Attorney, Agent, or Firm* — Morgan, Lewis & Bockius LLP

(57) ABSTRACT

A retractable interdental brush includes an interdental brush, a retractable mechanism, and a handle. The retractable mechanism is configured to drive the interdental brush to extend from the handle to clean a gap between teeth. After use, the interdental brush is retracted into an accommodation space of the handle through the retractable mechanism. The interdental brush may be a built-in interdental brush. When the built-in interdental brush is used for cleaning, a brush body may be first retracted into an elbow at a front end of a delivery device, an outlet of the elbow is pressed against the gap between teeth to push the brush body, and a working portion of the brush body and enters into the gap between teeth to clean the gap between teeth, thereby resolving a problem with existing interdental brush that easily stabs gingival tissue due to a difficulty of alignment with the gap between teeth.

10 Claims, 10 Drawing Sheets

(51) Int. Cl.
*A46B 7/02* (2006.01)
*A46B 9/02* (2006.01)

(56) References Cited

U.S. PATENT DOCUMENTS

| | | | | |
|---|---|---|---|---|
| 2009/0029323 | A1* | 1/2009 | Nejat | A46B 13/023 15/22.1 |
| 2009/0148808 | A1* | 6/2009 | Alexander | A61N 5/0603 433/29 |

FOREIGN PATENT DOCUMENTS

| | | | |
|---|---|---|---|
| CN | 204273618 | U | 4/2015 |
| CN | 104905547 | A | 9/2015 |
| CN | 206166159 | U | 5/2017 |
| CN | 107456289 | A | 12/2017 |
| JP | 2004113701 | A | 4/2004 |
| JP | 2004194777 | A | 7/2004 |
| JP | 2004313446 | A | 11/2004 |
| JP | 2017512608 | A | 5/2017 |
| WO | WO2016070294 | A1 | 5/2016 |

OTHER PUBLICATIONS

Zhou, Xing, International Search Report, PCT/CN2019/088426, Sep. 23, 2019, 4 pgs.
Zhou, Xing, International Preliminary Report on Patentability and Written Opinion, PCT/CN2019/088426, Sep. 23, 2019, 9 pgs.
Singh, Written Opinion, JP2021-531498, May 1, 2023, 8 pages.
Singh, Notice of Reasons for Refusal, JP2021-531498, Feb. 2, 2023, 10 pages.

* cited by examiner

RETRACTABLE INTERDENTAL BRUSH

CROSS-REFERENCE TO RELATED APPLICATIONS

This application is a continuation application of PCT Patent Application No. PCT/CN2019/088426, entitled "RETRACTABLE INTERDENTAL BRUSH" filed on May 24, 2019, which claims priority to Chinese Patent Application No. 201811648006.4, filed with the State Intellectual Property Office of the People's Republic of China on Dec. 29, 2018, and entitled "RETRACTABLE INTERDENTAL BRUSH", all of which are incorporated herein by reference in their entirety.

TECHNICAL FIELD

The present application relates to a tool for oral cavity cleaning, and in particular, to an interdental brush for cleaning a gap between teeth.

BACKGROUND

Due to reasons such as aging, pathology, and the like, gingival atrophy is easily caused, and the gap between teeth is easily expanded, thereby causing food residues. If the residues are not cleaned in time, not only oral odor may be generated, but also various dental diseases, oral diseases, and especially periodontitis are easily caused.

In view of this situation, various interdental brushes (or referred to as interdental brushes) have been developed on the market for users to choose. Although there are various products with different structures and specifications on the market, the existing products are generally difficult to be aligned with a gap between teeth and observe the gap between teeth. Moreover, the product is inconvenient to carry when the user goes out, and it is inconvenient to store after use. Especially, when a gap between a third molar and a second molar, or a gap between the second molar and a first molar, or a gap between the first molar and the second molar is cleaned, because a position of the gap between the teeth to be cleaned is located deep in an oral cavity, a brush body of the interdental brush in the prior art usually adopts a brush structure in which a metal wire is attached to a fiber made of a high polymer material. Therefore, the metal wire easily stabs gingival tissue during operation by feeling.

Due to the disadvantage that the interdental brush is difficult to enter the gap between teeth, easily stabs the gums, and is inconvenient to carry and use during cleaning the gap between the molars by the interdental brush of the prior art, the existing interdental brush needs to be improved.

SUMMARY

A retractable interdental brush of the present application is specially designed with a retractable mechanism. The interdental brush may be used after being pushed out. After being retracted, the interdental brush is placed in an accommodation space of a handle, forming a compact instrument box, which is very convenient to carry. In particular, the retractable interdental brush of the present application may be used in conjunction with a built-in interdental brush. During use, an outlet of a delivery device of the built-in interdental brush may directly push against a gap between teeth to push the interdental brush out of the delivery device to directly enter the gap between teeth, which is especially suitable for cleaning a molar in the deep oral cavity, and resolves the problem that the existing interdental brush easily stabs gingival tissue.

The retractable interdental brush of the present application includes an interdental brush 100, a retractable mechanism 200, and a handle 300, the handle 300 including an accommodation space 31, and the interdental brush 100 being capable of extending from or being retracted into the accommodation space 31 of the handle 300 through the retractable mechanism 200.

The retractable interdental brush of the present application can clean a gap between teeth when the interdental brush 100 is pushed out of the handle 300 through the retractable mechanism 200. When the retractable mechanism 200 is used to retract the interdental brush 100 into the accommodation space 31 of the handle 300, the handle 300 may form a compact instrument box, which is very convenient to carry.

The interdental brush 100 is a built-in interdental brush 101.

The built-in interdental brush 101 includes a brush body 11 and a delivery device 12, the brush body 11 being movably built in an elbow 12-1 at a front end of the delivery device 12. A working portion 11-1 of the brush body 11 may extend from or be retracted into the elbow 12-1 under the action of external force. During use, the brush body 11 may be first retracted into the elbow 12-1 at the front end of the delivery device 12, the outlet of the elbow 12-1 at the front end of the delivery device 12 is pushed against the gap between teeth to be cleaned to push the brush body 11, and the working portion 11-1 of the brush body 11 extends from the elbow 12-1 and enters the gap between teeth, thereby resolving a problem well that the existing interdental brush easily stabs gingival tissue due to a difficulty of alignment with the gap between teeth.

The brush body 11 is made of an elastic material, the elastic material being selected from an elastic polymer material or an elastic metal material. The brush body 11 can be mounted in the elbow 12-1 after being elastically deformed. When the brush body 11 extends from the elbow 12-1, the brush body 11 can be restored to the original shape again.

The brush body 11 may be linear. When the brush body 11 extends from the elbow 12-1, the brush body 11 can be restored or basically restored to the linear shape again. The brush body 11 may also be an arc-shaped brush body. When the brush body 11 extends from the elbow 12-1, the brush body 11 has an arc shape similar to that of an outer contour of the tooth.

In practical application, the fiber or a protrusion 11-11 of the working portion 11-1 of the brush body 11 may be made of the elastic polymer material, while a connecting body 11-2 of the brush body 11 may be made of the elastic metal material. In the process of injection molding in a metal mold, the connecting body 11-2 made of the elastic metal material and the fiber or the protrusion 11-11 made of the elastic polymer material are formed into a whole to form the brush body 11. In this way, the interdental brush with a composite structure not only ensures flexibility of the working portion 11-1 of the brush body 11, but also maintains overall elasticity and moderate rigidity of the brush body 11, and has good transitivity of force.

The brush body 11 may also be made of a shapeable material, and may be shaped to a certain extent in advance according to the external contour of teeth. When the brush body 11 extends from the elbow 12-1, the preset shape may be basically maintained.

The retractable mechanism 200 is a slide-type retractable mechanism or a rotation-type retractable mechanism. The retractable mechanism 200 may be a slide-type retractable mechanism, and the interdental brush 100 is pushed from or retracted into the handle 300 through sliding. The retractable mechanism 200 may also be a rotation-type retractable mechanism. For example, the interdental brush 100 is pushed from or retracted into the handle 300 by rotating the retractable mechanism 200 by using the movement mode of a threaded screw. Definitely, those skilled in the art may also design the retractable mechanism 200 with different structures as required without departing from the protection scope of this application.

The retractable mechanism 200 is a slide-type retractable mechanism 201. The slide-type retractable mechanism 201 includes a sliding groove 21 and a sliding block 22, the sliding block 22 being pushed to reciprocate along the sliding groove 21, so that the interdental brush 100 can extend from or be retracted into the handle 300. The sliding groove 21 may be disposed on a housing 32 of the handle 300, and the sliding block 22 is connected to a connecting portion 13 of the interdental brush 100 through a connecting end 22-1, so that the interdental brush 100 and the retractable mechanism 200 can be connected as a whole. During use, the sliding block 22 is pushed up and down to move up and down along the sliding groove 21. When the sliding block 22 moves upward, the sliding block 22 drives the interdental brush 100 to move upward, and the interdental brush 100 extends from the handle 300 to clean the gap between teeth. When cleaning is finished, the sliding block 22 is pushed downward to drive the interdental brush 100 to move downward, and the interdental brush 100 is retracted into the accommodation space 31 of the handle 300.

The interdental brush 100 is detachably mounted on the retractable mechanism 200. The interdental brush 100 is detachably mounted on the retractable mechanism 200, so that the interdental brush 100 can be replaced when needed, and the use process is cleaner and sanitary.

The interdental brush 100 is connected to the retractable mechanism 200 through concave-convex snap fit connection, threaded connection, or interference fit connection. The applicant herein only lists the foregoing detachable connection manners. Those skilled in the art may design different detachable connection manners as required without departing from the protection scope of this application.

The interdental brush 100 is non-detachably mounted on the retractable mechanism 200. The foregoing interdental brush 100 may also be non-detachably mounted on the retractable mechanism 200, which can effectively prevent the interdental brush 100 from falling off during use. Especially when the interdental brush 100 is a built-in interdental brush 101, the delivery device 12 may be fixedly mounted on the retractable mechanism 200 through the connecting portion 13, and only the brush body 11 needs to be replaced after cleaning, which not only meets the requirement of regular tool replacement and a sanitary requirement for convenience of cleaning, and prevents the interdental brush 100 from falling off the retractable mechanism 200 during the cleaning, so that the use process can be safer.

The interdental brush 100 is connected to the retractable mechanism 200 through bonding or integral manufacturing. The interdental brush 100 is fixedly connected to the retractable mechanism 200 in various manners such as bonding, integral manufacturing, ultrasonic welding, and the like.

During assembling, a bottom cover 33 of the handle 300 is first removed, the interdental brush 100 and the retractable mechanism 200 are connected, the interdental brush 100 and the retractable mechanism 200 are both placed into the accommodation space 31 from the bottom of the handle 300, and the sliding block 22 of the retractable mechanism 200 is mounted in the sliding block 21, and the bottom cover 33 is mounted.

During use, the sliding block 22 is pushed upward to push the interdental brush 100 out of the handle 300. If the interdental brush 100 is a built-in interdental brush 101, after the built-in interdental brush 101 is pushed out from the handle 300, the brush body 11 may be first retracted into the elbow 12-1 at the front end of the delivery device 12, the outlet of the elbow 12-1 at the front end of the delivery device 12 is pushed against the gap between teeth to be cleaned to push the brush body 11, and the working portion 11-1 of the brush body 11 extends from the elbow 12-1 and enters the gap between teeth, so that the gap between teeth can be cleaned.

The retractable interdental brush of the present application includes an interdental brush 100, a retractable mechanism 200, and a handle 300. The interdental brush 100 and the retractable mechanism 200 are connected to drive the retractable mechanism 200, so that the interdental brush 100 can be driven to extend from the handle 300 to clean the gap between teeth. After use, the retractable mechanism 200 is used to retract the interdental brush 100 into the accommodation space 31 of the handle 300, so that the handle 300 can form a compact instrument box, which is very convenient to carry. The interdental brush 100 of the retractable interdental brush of the present application may be a built-in interdental brush 101. When the built-in interdental brush 101 is used for cleaning, the brush body 11 may be first retracted into the elbow 12-1 at the front end of the delivery device 12, the outlet of the elbow 12-1 at the front end of the delivery device 12 is pushed against the gap between teeth to be cleaned to push the brush body 11, and the working portion 11-1 of the brush body 11 extends from the elbow 12-1 and enters the gap between teeth, thereby resolving a problem well that the existing interdental brush easily stabs gingival tissue due to a difficulty of alignment with the gap between teeth.

BRIEF DESCRIPTION OF THE DRAWINGS

FIG. 1-1 is a front view of FIG. 1.

FIG. 1-2 is a cross-sectional view of FIG. 1.

FIG. 2 is a three-dimensional schematic structural diagram of a brush body of FIG. 1 extending from an elbow of a delivery device.

FIG. 2-1 is a front view of FIG. 2.

FIG. 3-1 is a front view of FIG. 3.

FIG. 3-2 is a cross-sectional view of FIG. 3.

In the Foregoing Figure:

Figure 1:
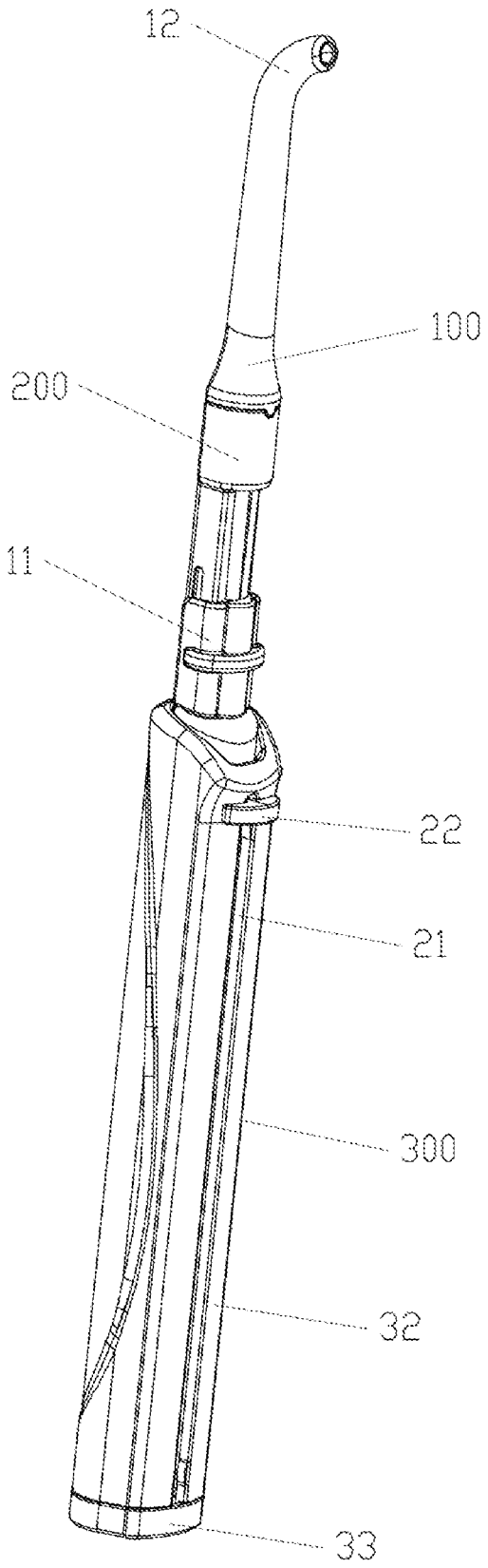
FIG. 1 is a three-dimensional schematic structural diagram of an interdental brush of a retractable interdental brush extending from a handle according to the present application.
Figure 1:
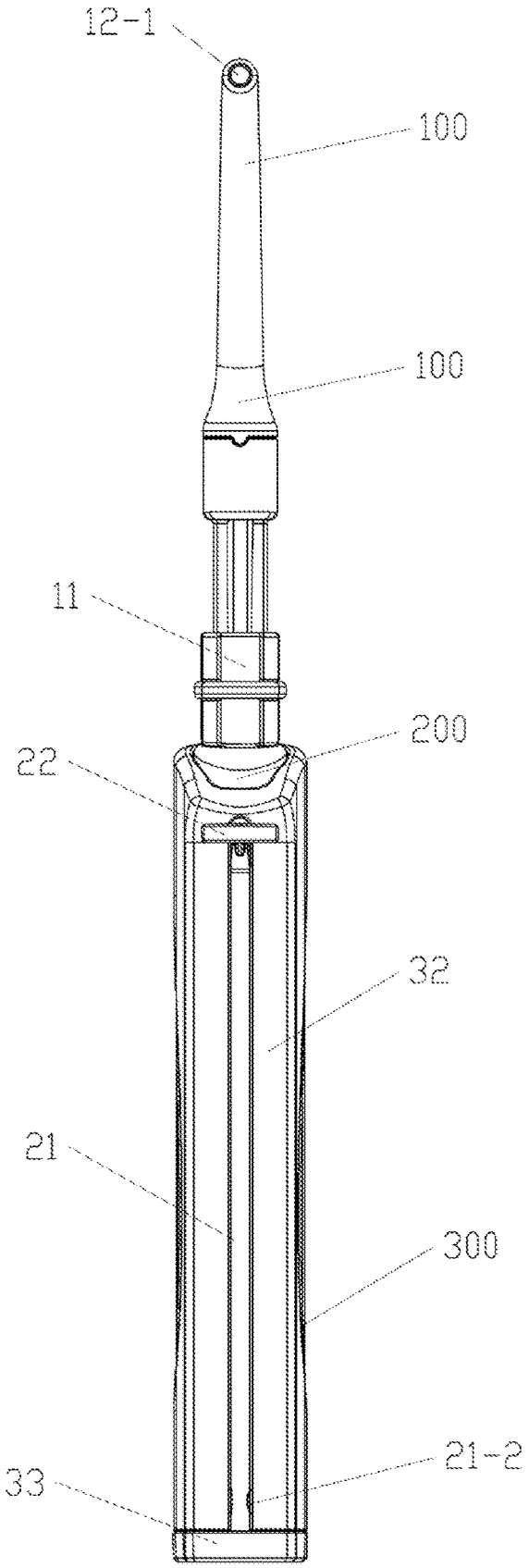

100 represents an interdental brush, 101 represents a built-in interdental brush, 200 represents a retractable mechanism, 201 represents a slide-type retractable mechanism, and 300 represents a handle.

11 represents a brush body, 12 represents a delivery device, and 13 represents a connecting portion: 11-1 represents a working portion, and 11-2 represents a connecting body: 11-11 represents a fiber or a protrusion.

21 represents a sliding groove, 22 represents a sliding block, 21-1 represents a locking block, 21-2 represents a limiting block, and 22-1 represents a connecting end.

31 represents an accommodation space, 32 represents a housing, and 33 represents a bottom cover.

DESCRIPTION OF EMBODIMENTS

Embodiment: Retractable Interdental Brush Including a Built-In Interdental Brush of the Present Application Referring to FIG. 1 to FIG. 4, a retractable interdental brush of the present application includes an interdental brush 100, a retractable mechanism 200, and a handle 300.

In the present embodiment, the interdental brush 100 is a built-in interdental brush 101.

The built-in interdental brush 101 includes a brush body 11 and a delivery device 12, the brush body 11 being movably built in an elbow 12-1 at a front end of the delivery device 12. A working portion 11-1 of the brush body 11 may extend from or be retracted into the elbow 12-1 under the action of external force.

Figures 1, 2:
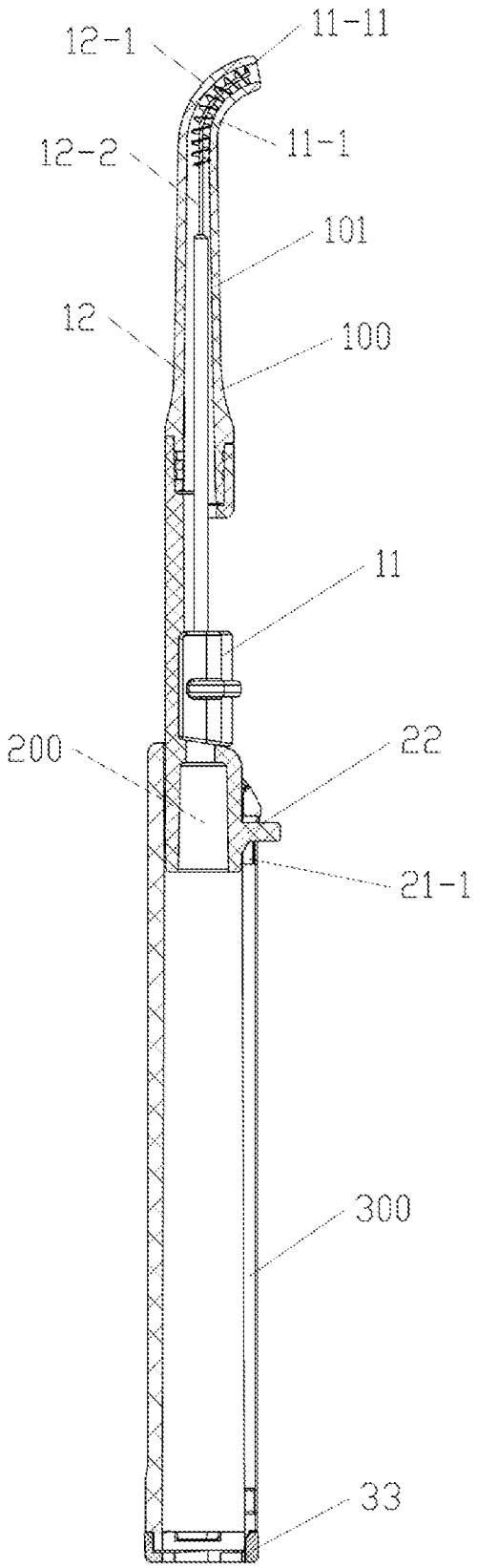
Figure 2:
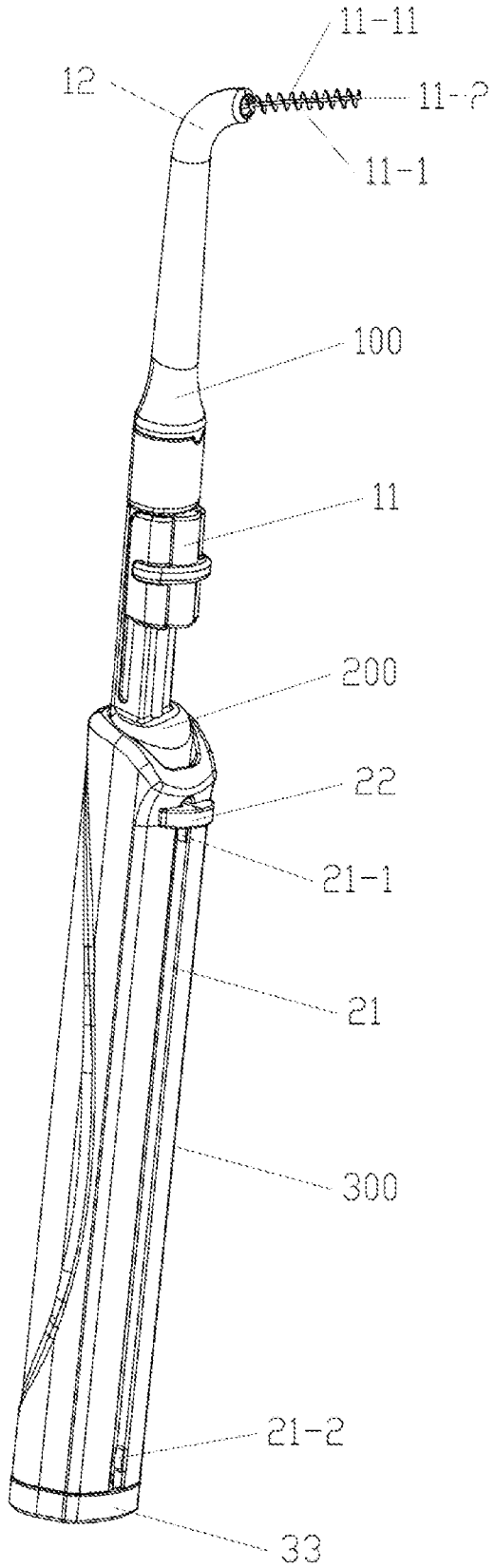
Figures 1, 2:
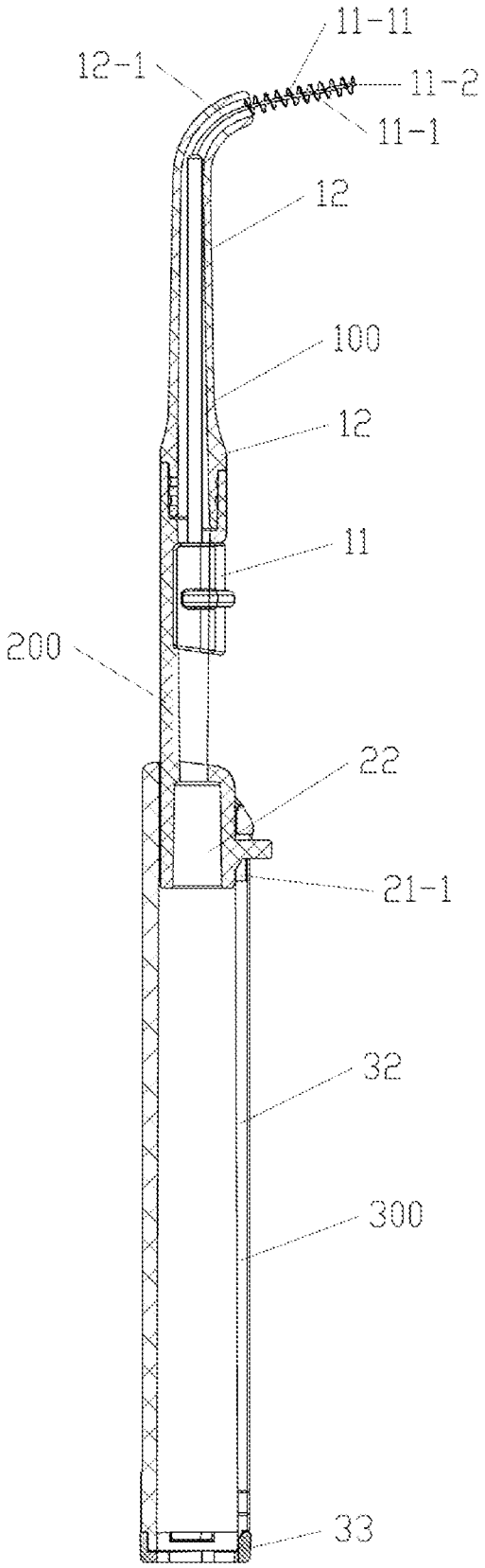
Figure 3:
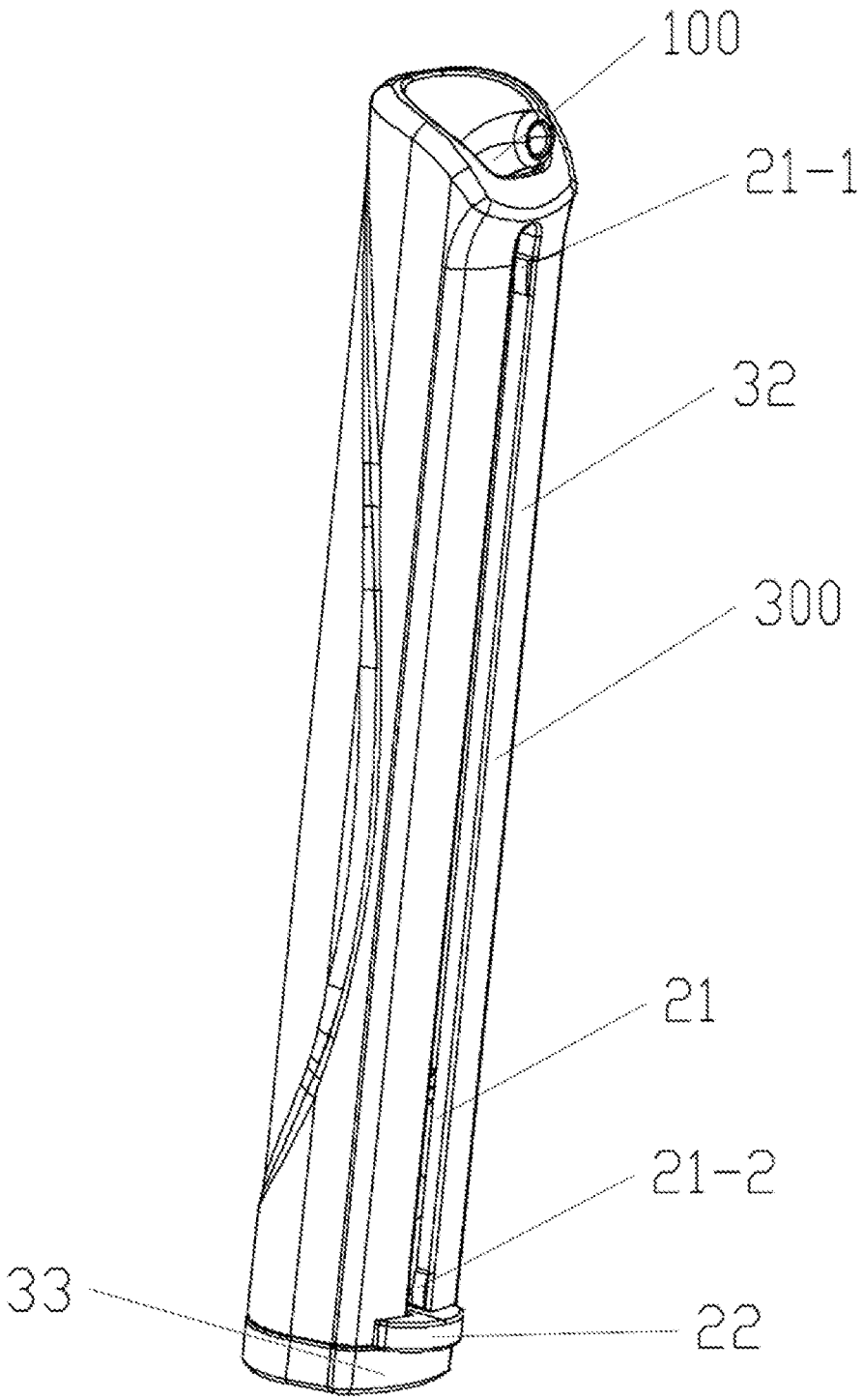
FIG. 3 is a three-dimensional schematic structural diagram of an interdental brush of a retractable interdental brush retracted into a handle according to the present application.
Figures 1, 3:
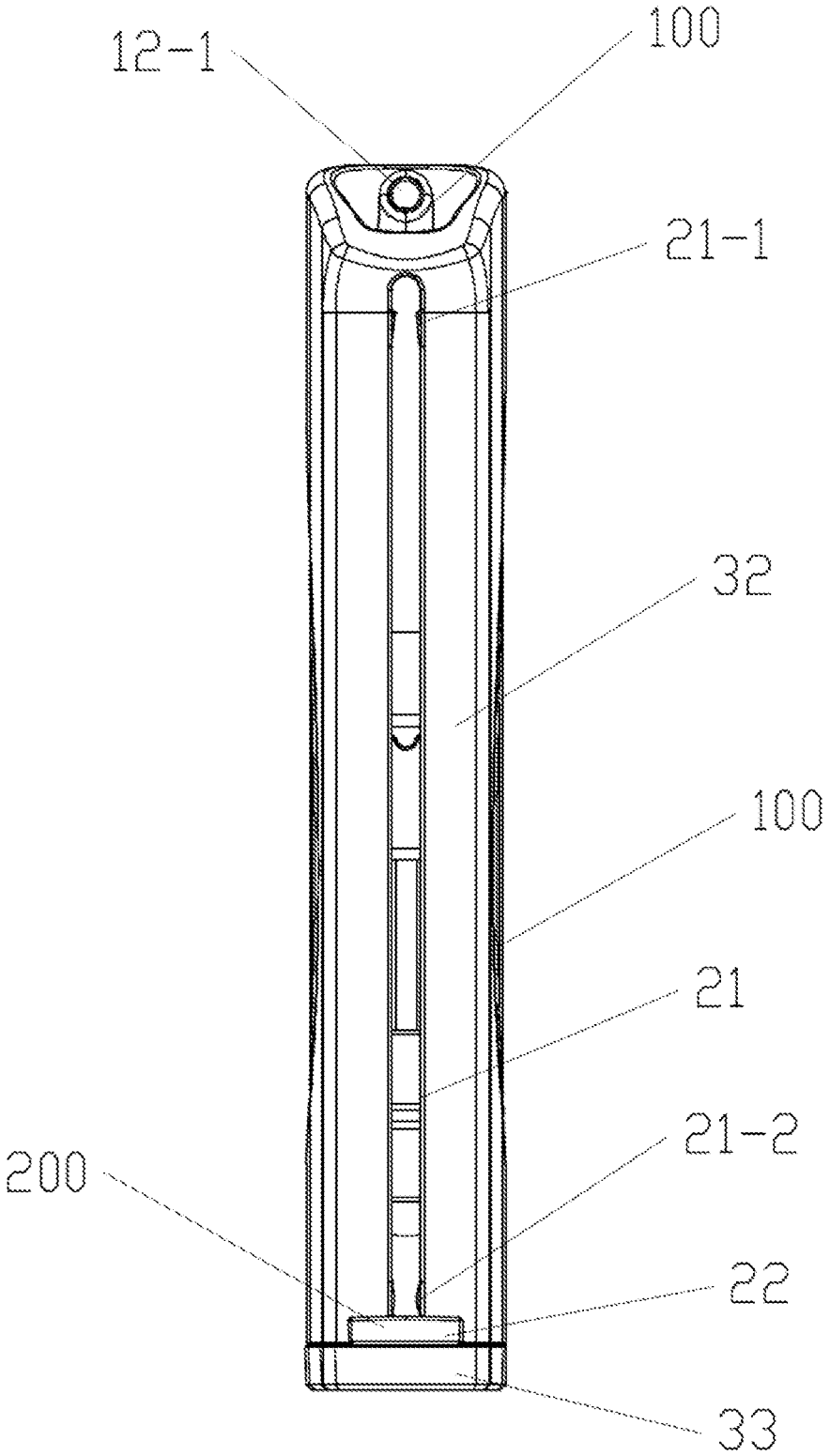
Figures 2, 3:
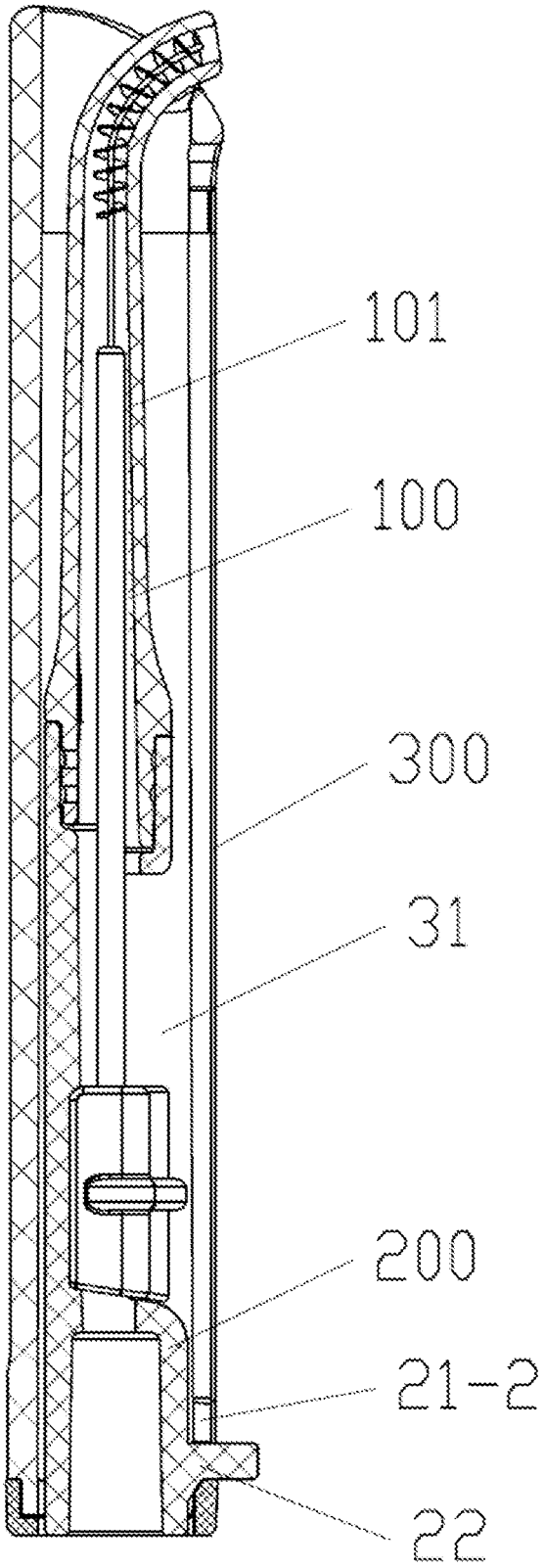
Figure 4:
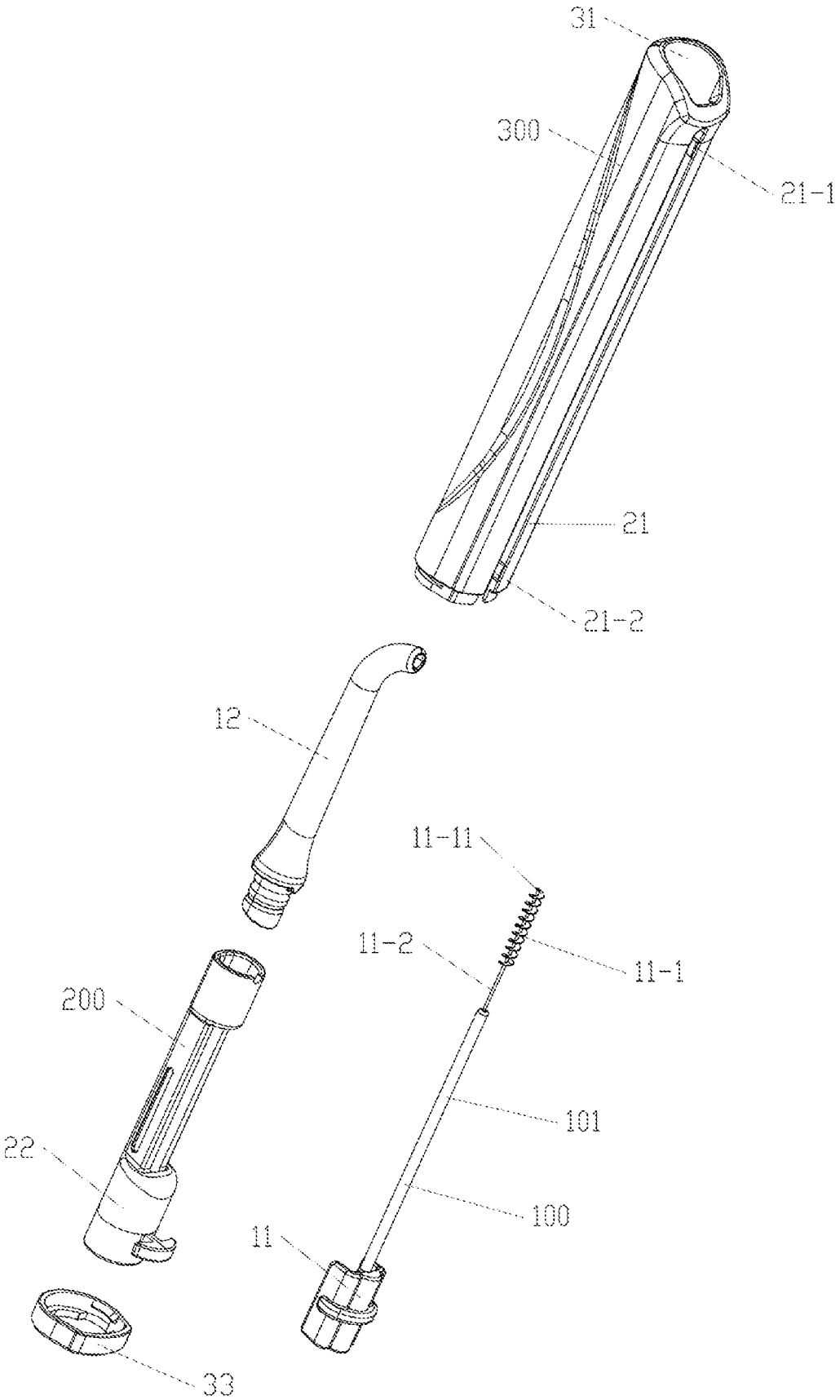
FIG. 4 is an exploded view of FIG. 1.

Referring to FIG. 2 and FIG. 4, in the present embodiment, the brush body 11 is linear and made of an elastic material. The brush body 11 can be mounted in the elbow 12-1 after being elastically deformed. When the brush body 11 extends from the elbow 12-1, the brush body 11 can be restored or basically restored to the linear shape again.

The elastic material is selected from an elastic polymer material or an elastic metal material. For example, a fiber or a protrusion 11-11 of the working portion 11-1 of the brush body 11 is made of the elastic polymer material, while a connecting body 11-2 of the brush body 11 is made of the elastic metal material. In the process of injection molding in a metal mold, the connecting body 11-2 made of the elastic metal material and the fiber or the protrusion 11-11 made of the elastic polymer material are formed into a whole to form the brush body 11. In this way, the interdental brush with a composite structure not only ensures flexibility of the working portion 11-1 of the brush body 11, but also maintains overall elasticity and moderate rigidity of the brush body 11, and has good transitivity of force.

Figure 5:
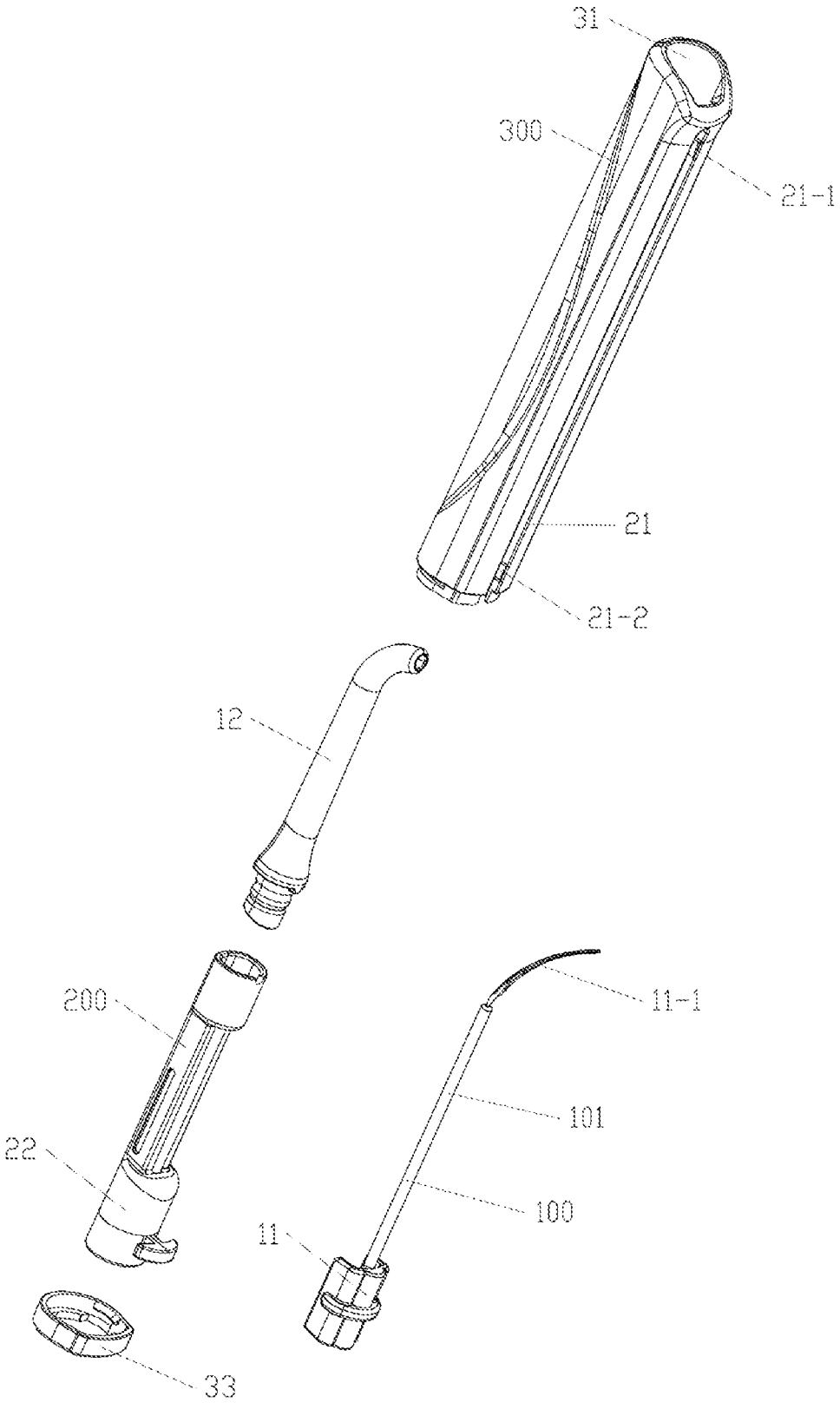
FIG. 5 is an exploded view of a retractable interdental brush of an arc-type interdental brush according to the present application.

Referring to FIG. 5, the brush body 11 may also be arc-shaped. When the brush body 11 extends from the elbow 12-1, the brush body 11 is in an arc shape, and the arc shape may be designed to be an arc shape similar to that of the outer contour of the tooth.

The brush body 11 may further be made of a shapeable material, for example, the connecting body 11-2 of the brush body 11 is made of a thin steel wire. The connecting body 11-2 of the brush body 11 may be shaped to a certain extent in advance according to the external contour of teeth. After the working portion 11-1 of the brush body 11 extends from the elbow 12-1, the preset shape may be basically maintained.

Definitely, those skilled in the art may further design different types of brush bodies, which are not described one by one by using an example by the applicant, and do not depart from the protection scope of this application.

In the present embodiment, the retractable mechanism 200 is a slide-type retractable mechanism 201. The slide-type retractable mechanism 201 includes a sliding groove 21 and a sliding block 22. The sliding block 22 being pushed to reciprocate along the sliding groove 21, so that the interdental brush 100 can extend from or be retracted into the handle 300.

The sliding groove 21 is disposed on a housing 32 of the handle 300, and the sliding block 22 is connected to a connecting portion 13 of the interdental brush 100 through a connecting end 22-1, so that the interdental brush 100 and the retractable mechanism 200 can be connected as a whole.

In order to ensure that the interdental brush 100 can be fixed outside the handle 300 after extending from the handle 300, a locking block 21-1 is disposed at an upper end of the sliding groove 21. In order to ensure that the interdental brush 100 can be fixedly accommodated in the handle 300 after being retracted into the handle, a limiting block 21-2 is disposed at a lower end of the sliding groove. When the sliding block 22 is pushed upward, and the sliding block 22 crosses the locking block 21-1, the interdental brush 100 may be fixed outside the handle 300, which can prevent the interdental brush 100 from sliding into the handle 300 during cleaning. When the sliding block 22 is pushed downward, and the sliding block 22 crosses the limiting block 21-2, the interdental brush 100 is fixed in the accommodation space 31 of the handle 300, which can prevent the interdental brush 100 from sliding out of the handle 300 during carrying.

The retractable mechanism 200 may also be a rotation-type retractable mechanism. For example, the interdental brush 100 is pushed from or retracted into the handle 300 by rotating the retractable mechanism 200 by using the movement mode of a threaded screw. Definitely, those skilled in the art may also design the retractable mechanism 200 with different structures as required without departing from the protection scope of this application.

In the present embodiment, the delivery device 12 of the built-in interdental brush 101 is fixedly mounted on the retractable mechanism 200 by bonding through the connecting portion 13, and only the brush body 11 needs to be replaced after cleaning, which not only meets the requirement of regular tool replacement and a sanitary requirement for convenience of cleaning, and prevents the interdental brush 100 from falling off the retractable mechanism 200 during the cleaning, so that the use process can be very safe.

The interdental brush 100 may further be fixedly connected to the retractable mechanism 200 in various manners such as integral manufacturing, ultrasonic welding, and the like, which are not described one by one by using an example by the applicant, and do not depart from the protection scope of this application.

When an ordinary interdental brush 100 is used, in order to facilitate the replacement of the interdental brush 100, the interdental brush 100 may be connected to the retractable mechanism 200 through concave-convex snap fit connection, threaded connection, or interference fit connection, which are not described in detail herein by the applicant.

During assembling, a bottom cover 33 of the handle 300 is first removed, the interdental brush 100 and the retractable mechanism 200 are connected, the interdental brush 100 and the retractable mechanism 200 are both placed into the accommodation space 31 from the bottom of the handle 300, and the sliding block 22 of the retractable mechanism 200 is mounted in the sliding block 21, and the bottom cover 33 is mounted.

During use, the sliding block 22 is pushed upward to push the built-in interdental brush 101 out of the handle 300. Then the brush body 11 may be first retracted into the elbow 12-1 at the front end of the delivery device 12, the outlet of the elbow 12-1 at the front end of the delivery device 12 is pushed against the gap between teeth to be cleaned to push the brush body 11, and the working portion 11-1 of the brush body 11 extends from the elbow 12-1 and enters the gap between teeth, so that the gap between teeth can be cleaned. In this way, the problem that the existing interdental brush easily stabs gingival tissue due to a difficulty of alignment with the gap between teeth may be resolved well.

After use, the sliding block 22 is pushed downward to drive the built-in interdental brush 101 to move downward, and the built-in interdental brush 101 is retracted into the accommodation space 31 of the handle 300. The handle 300 may form a compact instrument box, which is very convenient to carry and facilitates accommodation of the interdental brush 100.

Due to the built-in interdental brush, the retractable interdental brush of the present embodiment has many advantages such as convenience and safety in use and convenience for accommodation and carrying.

It should be noted that the structure disclosed and described in this specification may be replaced with another structure with the same effect. In addition, the embodiments described in the present application are not the only structure of implementing the present application. Although exemplary embodiments of the present application have been introduced and described in this specification, it should be understood by a person skilled in the art that the embodiments are merely described by way of example, and a person skilled in the art may make various changes, improvements, and replacements without departing from the present application. Therefore, the protection scope of the present application should be defined in accordance with the spirit and scope of the claims appended to the present application.

The invention claimed is:

1. A retractable interdental brush, comprising:

an interdental brush unit having (i) a brush body with a working portion and (ii) a delivery device with an open end, wherein the working portion of the brush body is configured to extend from or retract into the open end of the delivery device;

a retractable mechanism; and a handle, wherein:

the handle includes an accommodation space for stowing the interdental brush unit having the brush body and the delivery device in the accommodation space, and the interdental brush unit having the brush body and the delivery device are capable of extending from or retracting into the accommodation space of the handle via the retractable mechanism, wherein:

during use, the interdental brush unit having the brush body and the delivery device are adapted to extend from the accommodation space of the handle via the retractable mechanism; and after use, the interdental brush unit having the brush body and the delivery device are adapted to retract into the accommodation space of the handle via the retractable mechanism.

2. The retractable interdental brush according to claim 1, wherein the interdental brush unit is a built-in interdental brush unit.

3. The retractable interdental brush according to claim 2, wherein the delivery device includes an elbow at a front end of the delivery device and the brush body of the interdental brush unit is built in the elbow.

4. The retractable interdental brush according to claim 3, wherein the brush body is made of an elastic material, the elastic material being selected from an elastic polymer material or an elastic metal material.

5. The retractable interdental brush according to claim 1, wherein the retractable mechanism is a slide-type retractable mechanism or a rotation-type retractable mechanism.

6. The retractable interdental brush according to claim 5, wherein the retractable mechanism is a slide-type retractable mechanism, the slide-type retractable mechanism comprising a sliding groove and a sliding block, the sliding block being pushed to reciprocate along the sliding groove, so that the interdental brush unit can extend from or be retracted into the handle.

7. The retractable interdental brush according to claim 1, wherein the interdental brush unit is detachably mounted on the retractable mechanism.

8. The retractable interdental brush according to claim 7, wherein the interdental brush unit is connected to the retractable mechanism through concave-convex snap fit connection, threaded connection, or interference fit connection.

9. The retractable interdental brush according to claim 1, wherein the interdental brush unit is non-detachably mounted on the retractable mechanism.

10. The retractable interdental brush according to claim 9, wherein the interdental brush unit is connected to the retractable mechanism through bonding or integral manufacturing.

* * * * *